US011413735B2

(12) United States Patent
Akiba et al.

(10) Patent No.: US 11,413,735 B2
(45) Date of Patent: Aug. 16, 2022

(54) DRIVING TOOL

(71) Applicant: MAKITA CORPORATION, Anjo (JP)

(72) Inventors: Yoshitaka Akiba, Anjo (JP); Yukiyasu Okouchi, Anjo (JP)

(73) Assignee: MAKITA CORPORATION, Anjo (JP)

( * ) Notice: Subject to any disclaimer, the term of this patent is extended or adjusted under 35 U.S.C. 154(b) by 152 days.

(21) Appl. No.: 16/804,396

(22) Filed: Feb. 28, 2020

(65) Prior Publication Data

US 2020/0306941 A1 Oct. 1, 2020

(30) Foreign Application Priority Data

Mar. 27, 2019 (JP) ..... JP2019-060455

(51) Int. Cl.
*B25C 1/06* (2006.01)
*B25C 1/00* (2006.01)
*B25C 1/04* (2006.01)

(52) U.S. Cl.
CPC ..... *B25C 1/06* (2013.01); *B25C 1/005* (2013.01); *B25C 1/04* (2013.01)

(58) Field of Classification Search
CPC .. B25C 1/06; B25C 1/005; B25C 1/04; B25C 1/182; B25C 3/002
See application file for complete search history.

(56) References Cited

U.S. PATENT DOCUMENTS 3,688,966 A * 9/1972 Perkins ..... B25C 1/003 227/127
7,225,962 B2 * 6/2007 Porth ..... B25C 5/1627 227/135
8,276,798 B2 * 10/2012 Moeller ..... B25C 5/1627 227/120
9,770,818 B2 * 9/2017 Largo ..... B25C 1/041
11,097,408 B2 * 8/2021 Akiba ..... B25C 1/06
2004/0232194 A1 * 11/2004 Pedicini ..... B25C 1/06 227/131
2008/0314953 A1 * 12/2008 Moeller ..... B25C 5/1627 227/109
2013/0082083 A1 * 4/2013 Largo ..... B25C 1/041 227/8
2021/0347022 A1 * 11/2021 Leathrum ..... B25C 1/003

FOREIGN PATENT DOCUMENTS

JP 2013-188849 A 9/2013
JP 2016-203292 A 12/2016

* cited by examiner

*Primary Examiner* — Chelsea E Stinson
*Assistant Examiner* — Scott A Howell
(74) *Attorney, Agent, or Firm* — Oliff PLC

(57) ABSTRACT

A driving tool includes an electric motor, a battery mount that receives a battery for powering the electric motor, a flywheel that rotates by the electric motor, a magazine that loads a connected fastener rolled in a coil and including a plurality of fasteners temporarily connected in parallel, an impact driver that advances through a driving path with rotational power of the flywheel to drive the fasteners, and a feed mechanism that feeds the connected fastener by a pitch from the magazine toward the driving path.

6 Claims, 15 Drawing Sheets

DRIVING TOOL

CROSS-REFERENCE TO RELATED APPLICATIONS

This application claims the benefit of priority to Japanese Patent Application No. 2019-060455, filed on Mar. 27, 2019, the entire contents of which are hereby incorporated by reference.

BACKGROUND

1. Technical Field

The present invention relates to a driving tool for driving fasteners including nails.

2. Description of the Background

A driving tool incorporates, in its body, a long impact driver for driving fasteners in a drive direction. A wide variety of power sources are used to move an impact driver in the drive direction. One example is a compressed-air-driven driving tool, which is powered by compressed air externally fed through an air hose. Another example is a flywheel-driven driving tool as a hoseless driving tool with no air hose connection. A flywheel-driven driving tool is powered by rotation of a flywheel for a driving operation. Japanese Patent Application Publication No. 2016-203292 (hereafter, Patent Literature 1) describes a flywheel-driven driving tool.

A flywheel-driven driving tool presses an impact driver against a flywheel to move downward (advance) in the drive direction. The flywheel is rotated by an electric motor. The impact driver, after driven by a flywheel, returns to an upper limit position with a winder using a spring force from, for example, a spiral spring.

An electric motor is used as a power source for rotating a flywheel. A flywheel-driven driving tool thus includes a battery (direct-current or DC power source) to power the electric motor, eliminating a hose.

A battery-powered driving tool includes a magazine loadable with many fasteners. A known magazine is loaded with a plate-like connected fastener, which includes many fasteners temporarily connected in parallel. When loaded, the connected fasteners are constantly pushed toward a driving path under an urging force from a compression spring. When driven, one fastener at a time is pushed out and fed to an empty portion of the driving path.

Magazines commonly incorporated in a compressed-air-driven driving tool are loaded with a connected fastener, which is temporarily connected with a resin sheet or wires in parallel at regular intervals and rolled in a coil. A magazine loaded with a connected fastener rolled in a coil includes a feed mechanism that feeds the connected fastener by a pitch toward the driving path by reciprocating a feed tab using compressed air from a tool body. A known technique relating to a feed-tab feed mechanism is described in Japanese Patent Application Publication No. 2013-188849 (hereafter, Patent Literature 2).

BRIEF SUMMARY

A driving tool powered by a known battery incorporates no magazine loaded with a connected fastener in a rolled manner.

One or more aspects of the present invention are directed to a hoseless driving tool powered by a battery and incorporating a magazine loaded with connected fasteners rolled in a coil.

An aspect of the present invention provides a driving tool, including:

- an electric motor;
- a battery mount configured to receive a battery for powering the electric motor;
- a flywheel configured to rotate by the electric motor;
- a magazine configured to load a connected fastener rolled in a coil, the connected fastener including a plurality of fasteners temporarily connected in parallel;
- an impact driver configured to advance through a driving path with rotational power of the flywheel to drive the fasteners; and
- a feed mechanism configured to feed the connected fastener by a pitch from the magazine toward the driving path.

The flywheel-driven driving tool according to the above aspect of the present invention incorporates a coil magazine, instead of a known magazine loaded with a plate-like connected fastener, thus expanding a range of usable magazines.

DETAILED DESCRIPTION

First Embodiment

Figure 1:
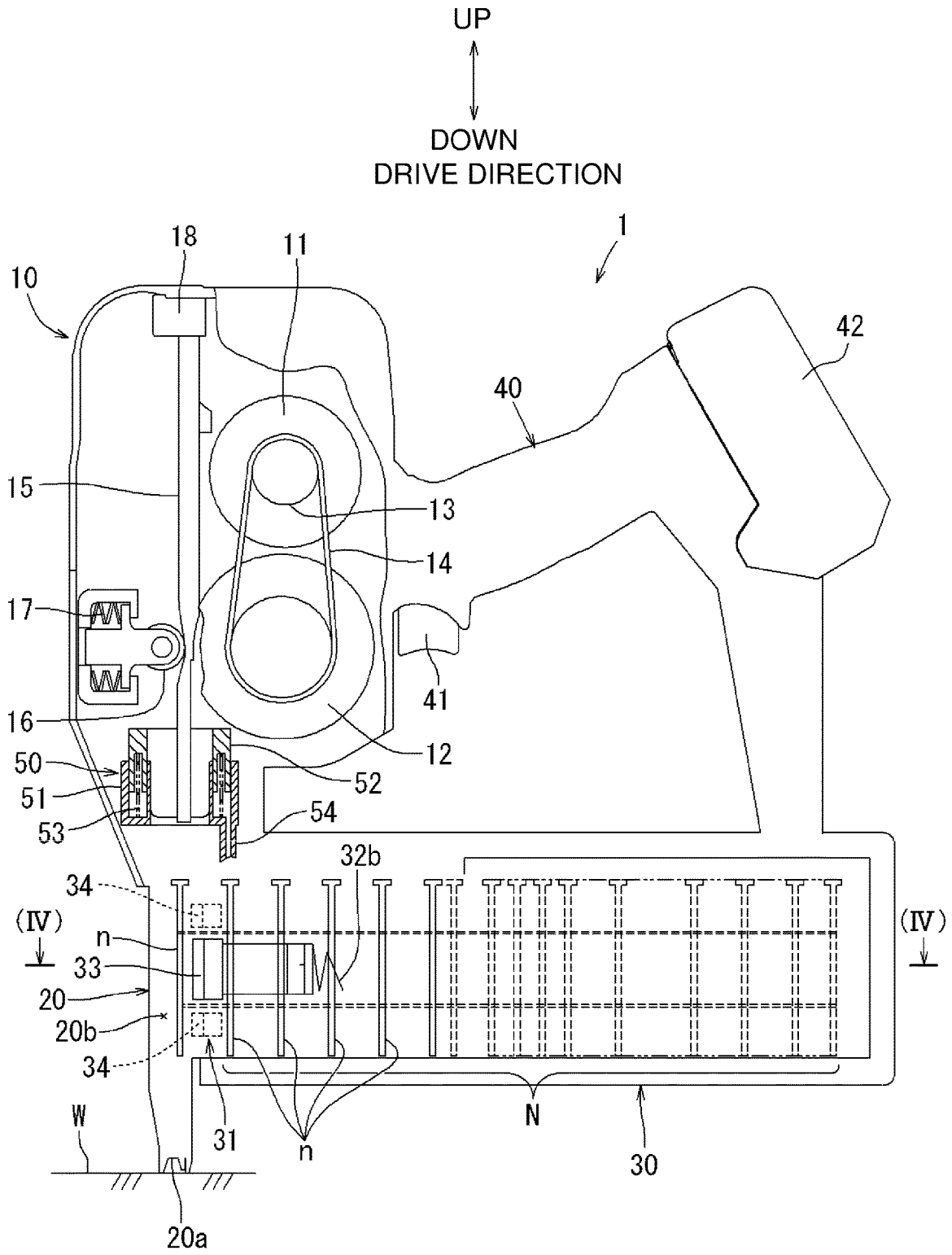
FIG. 1 is an overall side view of a flywheel-driven driving tool according to a first embodiment in a driving standby state with an impact driver returning to an upper limit position.

A first embodiment will now be described with reference to FIGS. 1 to 5. FIG. 1 shows a driving tool according to a first embodiment. A driving tool 1 according to the first embodiment is a hoseless driving tool with no air hose connection. The driving tool 1 is, for example, a flywheel-driven direct-current (DC) driving tool 1, using the rotational power (energy) of a flywheel as a thrust for a driving operation.

As shown in FIG. 1, the driving tool 1 according to the first embodiment includes a tool body 10, a driving nose 20, a magazine 30, and a handle 40. Fasteners n are driven through the driving nose 20. The magazine 30 accommodates many fasteners n. The handle 40 is gripped by a user. The handle 40 includes, at its base, a switch lever 41 for activating a driving operation. The handle 40 includes a battery mount at its distal end. A battery 42, which is a direct-current power source, is attached to the battery mount. The battery 42 is detachable and rechargeable by a separate charger and is repeatedly usable as a power source.

The magazine 30 is loaded with a connected fastener N rolled in a coil (coil magazine). The connected fastener N includes many fasteners n temporarily connected in parallel. The magazine 30 is supported between the driving nose 20 and the handle 40. The magazine 30 is connected to the driving nose 20 via a feed mechanism 31. The feed mechanism 31 feeds the loaded connected fastener N by a pitch. The feed mechanism 31 will be described in detail later.

The flywheel-driven tool body 10 includes a flywheel 12. The flywheel 12 is rotated by a wheel motor 11, which serves as a driving source. The wheel motor 11 activates with power from the battery 42 in response to turning on of a contact arm. A driving belt 14 extends around and between the flywheel 12 and an output wheel 13 mounted on the output shaft of the wheel motor 11. The rotational power of the wheel motor 11 is transmitted to the flywheel 12 through the driving belt 14. An impact driver 15 is pressed against the circumferential surface of the flywheel 12. The rotational power of the flywheel 12 is then transmitted to the impact driver 15 as a thrust in a drive direction.

A press roller 16 opposes the flywheel 12 across the impact driver 15. A pull of the switch lever 41 presses the press roller 16 against the impact driver 15. The press roller 16 is pressed against the impact driver 15 under an urging force from a press spring 17. Thus, the impact driver 15 is held between the flywheel 12 and the press roller 16. The impact driver 15 held between them is released by a release mechanism (not shown) that releases the press roller 16 from pressing. An electromagnetic actuator is used as the release mechanism. When the pulled switch lever 41 is released, the release mechanism releases the press roller 16 from pressing.

Figure 2:
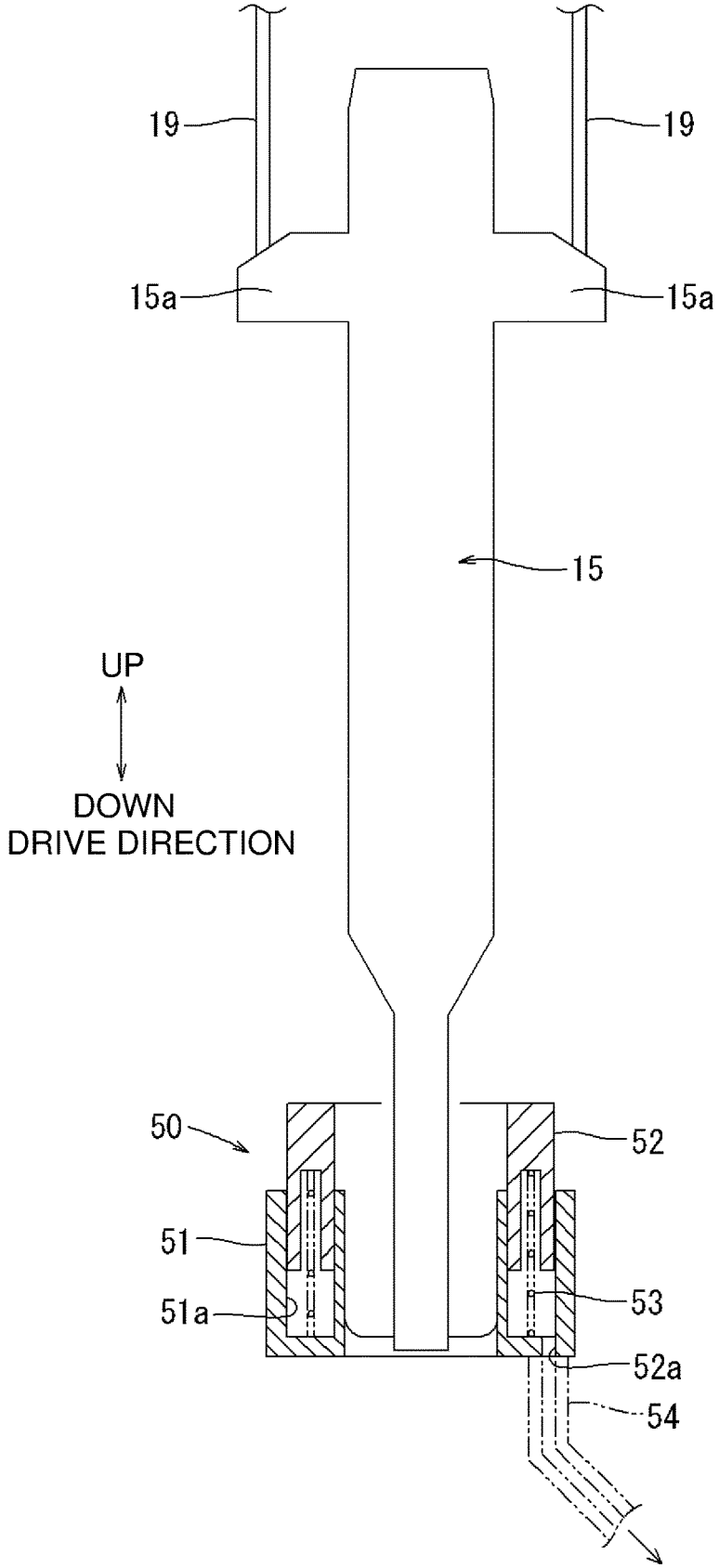
FIG. 2 is a longitudinal sectional view of an air generator with the impact driver returning to an upper limit position and a lower limit damper as the air generator extending upward.
Figure 3:
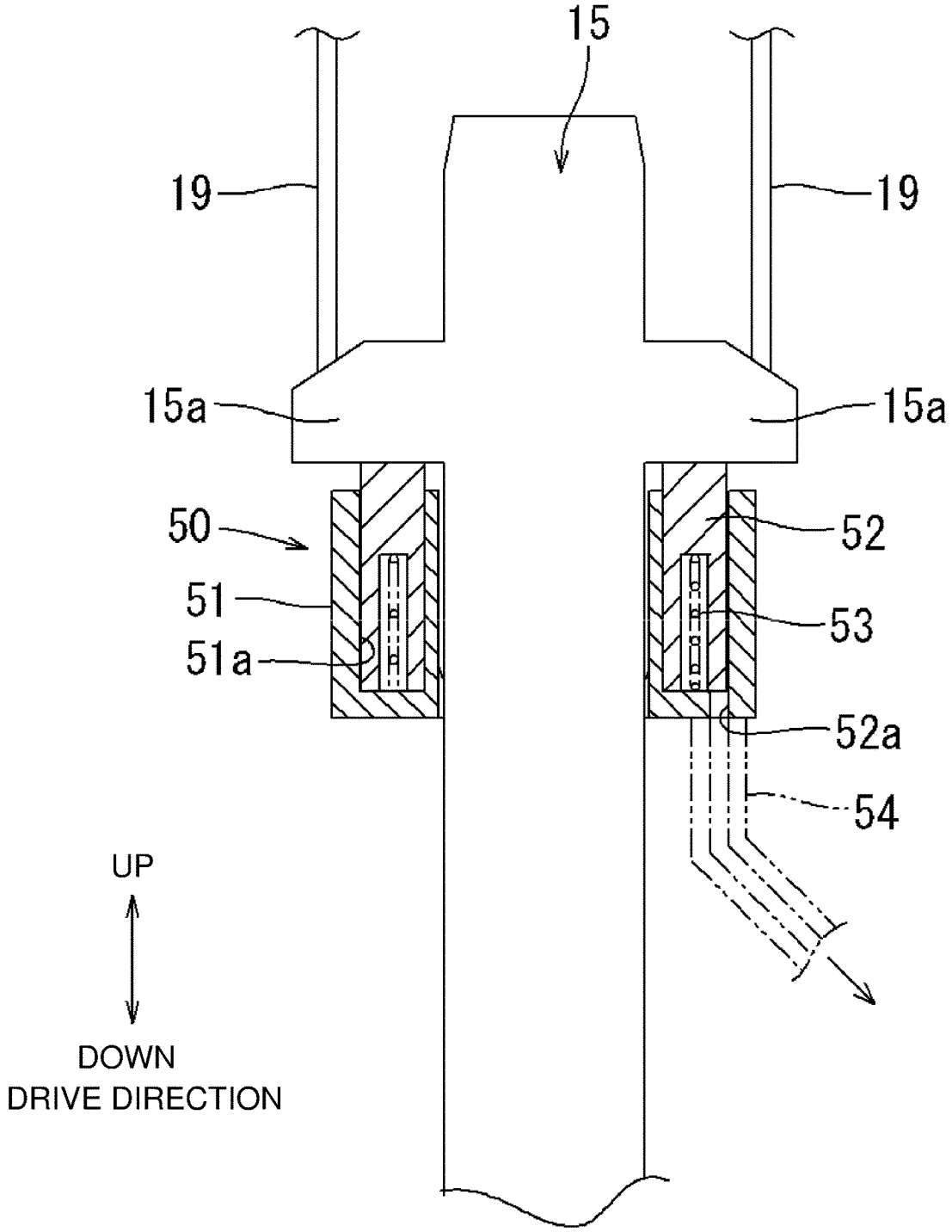
FIG. 3 is a longitudinal sectional view of the air generator with the lower limit damper as the air generator being compressed by the impact driver moving downward to discharge compressed air.

The impact driver 15 returns to an upper limit position with a winder using a spring force. The impact driver 15 is held at the upper limit position while being in contact with an upper limit damper 18. As shown in FIGS. 2 and 3, the impact driver 15 integrally includes shoulders 15*a* extending rightward and leftward from its upper portion. The right and left shoulders 15*a* are connected to wires 19, which are wound by the winder. When the press roller 16 is released from pressing, the right and left wires 19 are wound under the spring force from the winder, thus returning the impact driver 15 to the upper limit position.

When the switch lever 41 is pulled, the press roller 16 is pressed against the impact driver 15 to hold the impact driver 15 between the press roller 16 and the flywheel 12. Thus, the impact driver 15 moves downward (advances) in the drive direction against a winding force from the winder under the rotational power of the flywheel 12. The impact driver 15 moves downward through a driving path 20*b* to drive a fastener n. An annular lower limit damper 50 is located at the lower limit of the impact driver 15. When the impact driver 15 reaches the lower limit, the right and left shoulders 15*a* come in contact with the lower limit damper 50. The lower limit damper 50 limits downward movement of the impact driver 15 and absorbs impact.

The impact driver 15 moves into the driving path 20*b* in the driving nose 20 after passing through the internal circumference of the lower limit damper 50. The driving nose 20 has a nozzle 20*a* at its distal end. The driving nose 20 includes a contact arm (not shown) that presses the driving nose 20 against a workpiece W and relatively moves the driving nose 20 upward. The distal end (nozzle 20*a*) of the driving nose 20 is directed to the workpiece W and the contact arm is moved upward, allowing the driving operation to be ready. This prevents an unintended driving operation.

The lower limit damper 50 absorbs impact on the impact driver 15 at the lower limit. The lower limit damper 50 also serves as an air generator for generating compressed air. The lower limit damper 50 includes a cylindrical base 51 and a cylindrical contact portion 52. The base 51 has an annular groove 51*a* open in the upper surface. The groove 51*a* receives a lower portion of the contact portion 52, and supports the contact portion 52 in a vertically movable manner relative to the base 51. The groove 51*a* is sealed airtightly. A single compression spring 53 is placed between the bottom of the groove 51*a* and the contact portion 52. The compression spring 53 urges the contact portion 52 upward.

Immediately before the impact driver 15 reaches the lower limit, the right and left shoulders 15*a* come in contact with the upper surface of the contact portion 52. The impact driver 15 moving downward moves the contact portion 52 downward against the compression spring 53. The contact portion 52 moving downward generates compressed air in the groove 51*a*. A spring force from the compressed air and an urging force from the compression spring 53 absorb impact on the impact driver 15 at the lower limit. The lower limit damper 50 can thus absorb impact on the impact driver 15 at the lower limit and can generate compressed air.

An air channel 54 is connected to the bottom of the groove 51*a* through a vent 52*a*. Compressed air generated in the groove 51*a* with the impact driver 15 moving downward is fed to a feed cylinder 32 in the feed mechanism 31 through the air channel 54.

Figure 4:
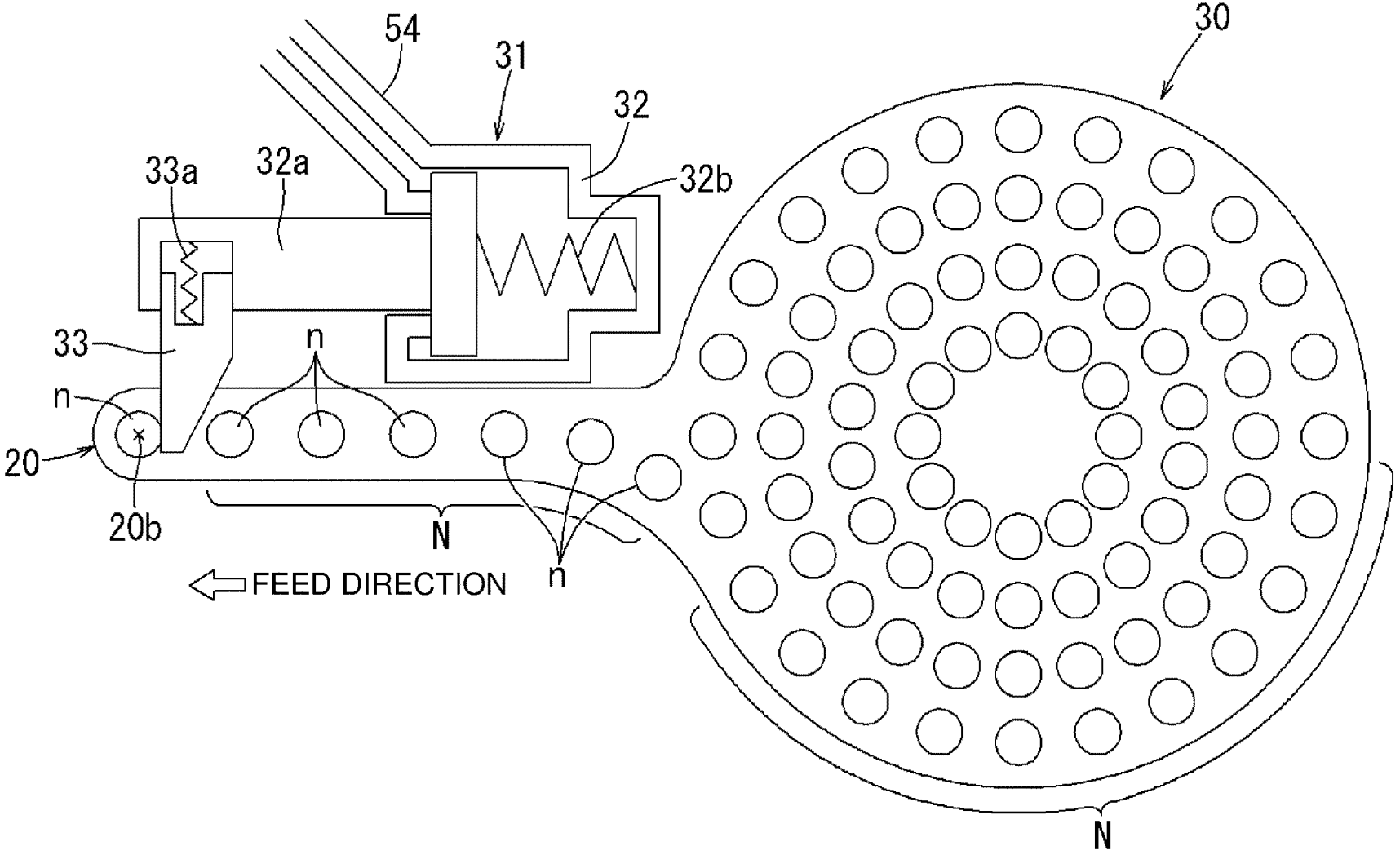
FIG. 4 is a cross-sectional view of a magazine and a feed mechanism taken along line IV-IV as viewed in the direction indicated by arrows in FIG. 1, in which a feed tab on the feed mechanism for feeding fasteners is shifted to a feed position.
Figure 5:
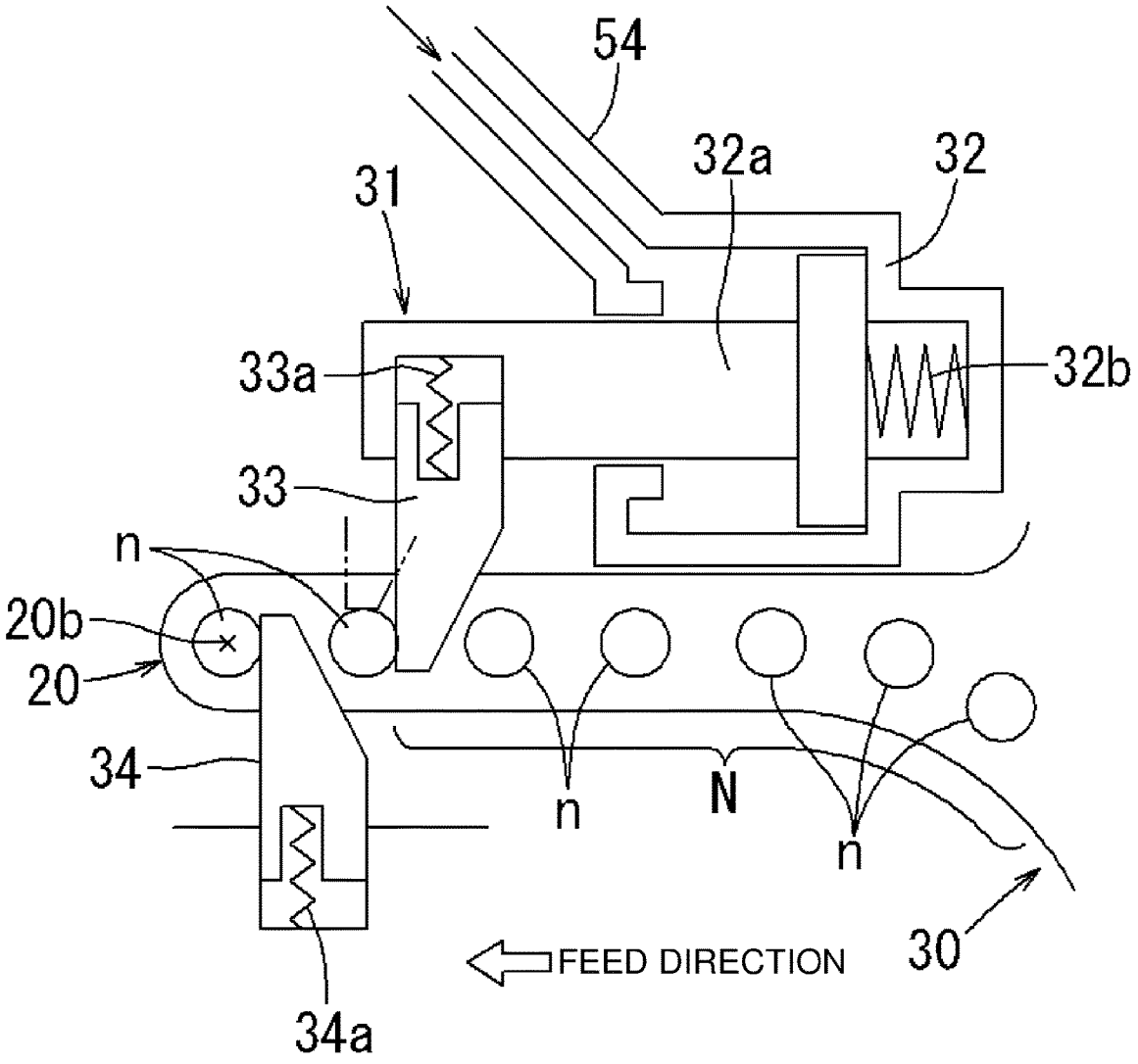
FIG. 5 is a cross-sectional view of a magazine and a feed mechanism with the feed tab on the feed mechanism returning in a reverse direction.

As shown in FIGS. 4 and 5, the feed mechanism 31 feeds the connected fastener N loaded in the magazine 30 by a pitch toward the driving nose 20 in cooperation with the driving operation of the tool body 10. The feed mechanism 31 includes a single-acting feed cylinder 32. The feed cylinder 32 retracts a feed rod 32*a* with compressed air fed from the lower limit damper (air generator) 50 through the air channel 54. When compressed air is discharged, the feed cylinder 32 advances the feed rod 32*a* with a compression spring 32*b*. The feed rod 32*a* supports a feed tab 33. The feed tab 33 is urged by a compression spring 33*a* to protrude toward the fasteners n.

The feed mechanism 31 includes two stopper tabs 34 located opposite to the feed tab 33 across a feed path in the feed mechanism 31. The two stopper tabs 34 are arranged on both ends of the feed tab 33 in the longitudinal direction of the fasteners n. The two stopper tabs 34 are urged by corresponding compression springs 34*a* to protrude toward the fasteners n. The stopper tabs 34 prevent the connected fastener N from shifting in the reverse direction.

When the impact driver 15 reaches the lower limit and completes driving of one fastener n, compressed air generated by the lower limit damper 50 is fed to the feed cylinder 32 through the air channel 54. When compressed air is fed to the feed cylinder 32, as shown in FIG. 5, the feed rod 32*a* shifts under the air pressure of the compressed air to retract against the compression spring 32*b*. This retracts the feed tab 33 in the reverse direction. The feed tab 33 moves in a direction opposite to one fastener n (moves upward in FIGS. 4 and 5) against the compression spring 33*a* and slides over the fastener n while retracting.

As shown in FIG. 5, when the feed tab 33 retracts in the reverse direction, the two stopper tabs 34 are engaged with the rear of a fastener n preceding in the feed direction to restrict the connected fastener N from returning in the reverse direction. In this state, the feed tab 33 returns by one pitch (a pitch corresponding to a single fastener n) in the reverse direction.

Thus, the feed tab 33 is engaged with a second fastener n in a feed standby state. After the impact driver 15 reaches the lower limit and completes driving of one fastener n, the pulled switch lever 41 is released. This returns the press roller 16 to a release position, causing the winder to return the impact driver 15 to an upper limit. When the impact driver 15 moves upward from the lower limit, the contact portion 52 of the lower limit damper 50 returns upward under an urging force from the compression spring 53. When the contact portion 52 returns upward from the base 51, air to be compressed returns to the groove 51*a*.

The air compressed and fed to the feed cylinder 32 thus returns to the groove 51*a*. The feed rod 32*a* then advances in the feed direction under an urging force from the compression spring 32*b*, and the feed tab 33 shifts in the feed direction. Thus, the connected fastener N is fed in the feed direction by one pitch. Then, another fastener n is fed to the empty driving path 20*b* after the impact driver 15 retracts upward. The fed fastener n is driven through the nozzle 20*a* in the subsequent driving operation.

In the driving tool 1 according to the first embodiment, the feed mechanism 31 feeds the connected fastener N rolled in a coil and loaded in the magazine 30 by a pitch in cooperation with the driving operation of the tool body 10. Thus, the driving tool 1 can sequentially drive many fasteners n loaded in the magazine 30, as in a known tool.

The driving tool 1 according to the present embodiment includes the magazine 30 (coil magazine) loadable with the connected fastener N rolled in a coil. The magazine 30 loaded with the connected fastener N rolled in a coil is usable instead of a known magazine loaded with a plate-like connected fastener. The DC driving tool can thus expand a range of usable magazines.

Second Embodiment

Figure 6:
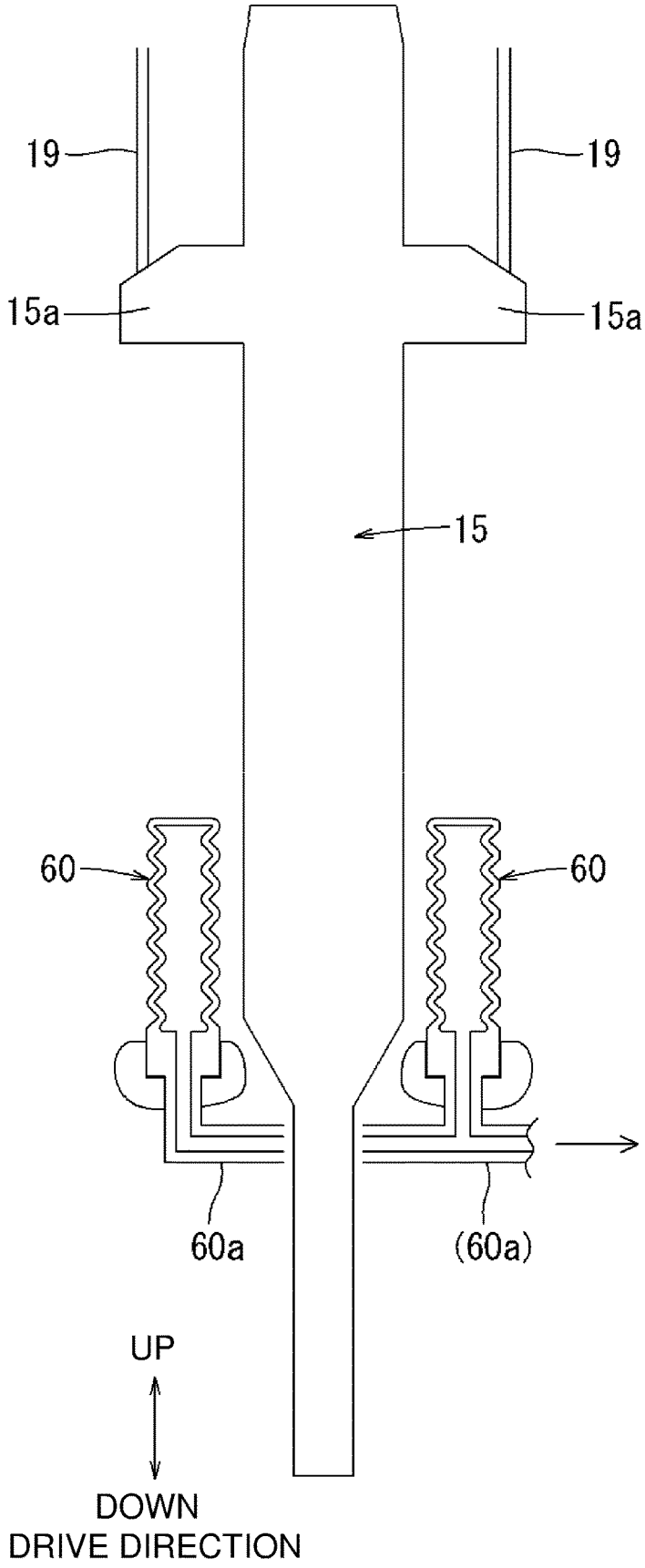
FIG. 6 is a longitudinal sectional view of a lower limit damper with an impact driver according to a second embodiment returning to an upper limit position and a lower limit damper as the air generator extending upward.
Figure 7:
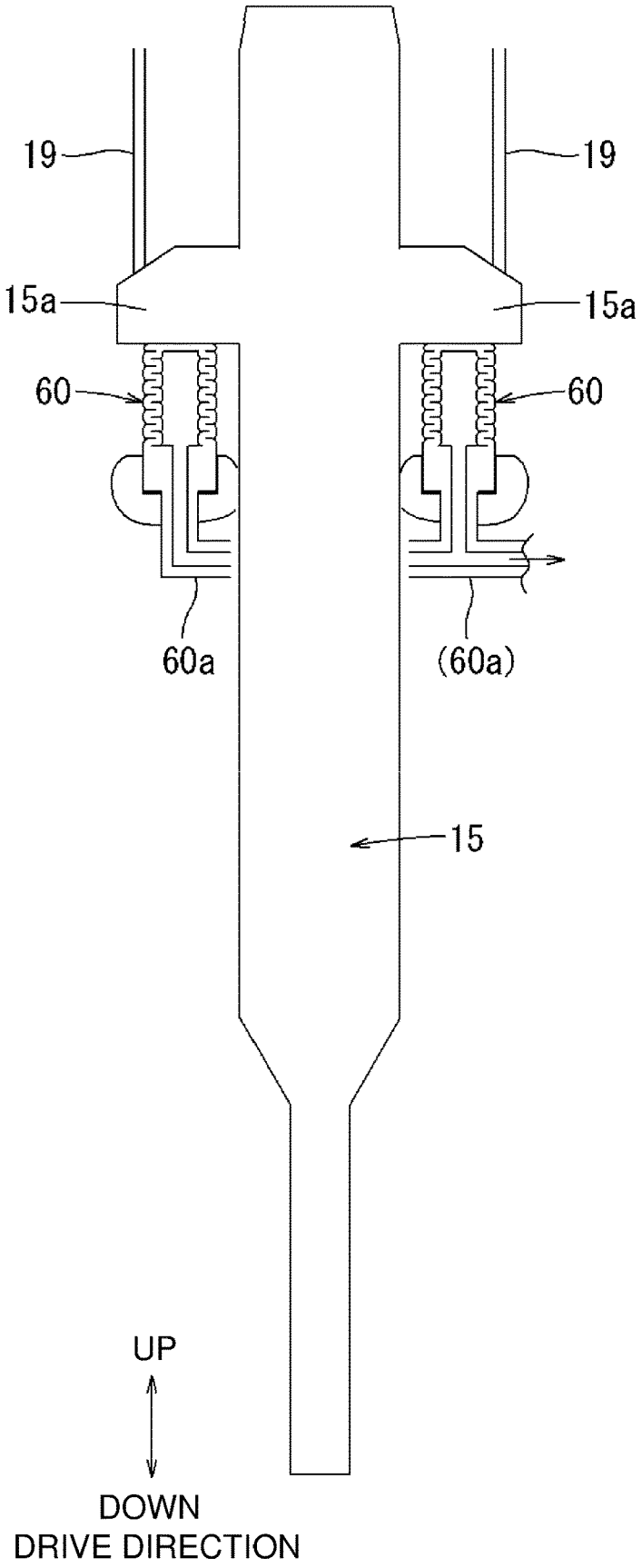
FIG. 7 is a longitudinal sectional view of the lower limit damper as the air generator being compressed by the impact driver according to the second embodiment moving downward to discharge compressed air.

The first embodiment may be modified variously. FIGS. 6 and 7 show lower limit dampers 60 according to a second embodiment, instead of the lower limit damper 50 according to the first embodiment. The second embodiment includes two, right and left lower limit dampers 60 instead of the single annular lower limit damper 50. Unlike the structure including a compression spring placed between two members as in the first embodiment, simpler bellows-shaped air cushions formed from a vinyl sheet are used as the lower limit dampers 60.

As in the first embodiment, the right and left lower limit dampers 60 according to the present embodiment also serve as air cushions that absorb impact on the impact driver 15 using gas pressure, and serve as air generators for generating compressed air. As in the first embodiment, when the switch lever 41 is turned on, the impact driver 15 moves downward to perform a striking operation. Immediately before the impact driver 15 reaches the lower limit, the right and left shoulders 15*a* come in contact with the lower limit dampers 60. As shown in FIG. 7, the impact driver 15 moving downward presses the right and left lower limit dampers 60 downward to contract. The contracted right and left lower limit dampers 60 absorb impact on the impact driver 15 at the lower limit, and generate compressed air in the lower limit dampers 60.

The right and left lower limit dampers 60 each include an air channel 60*a* through which the generated compressed air is discharged. The right and left air channels 60*a* are merged and connected to the feed cylinder 32 in the feed mechanism 31. Compressed air generated with the impact driver 15 reaching the lower limit to contract the right and left lower limit dampers 60 is fed to the feed cylinder 32 through the air channels 60*a*.

As in the first embodiment, when the compressed air is fed to the feed cylinder 32, the feed tab 33 returns by a pitch corresponding to a single fastener n in the reverse direction. When the feed tab 33 returns, the stopper tabs 34 are engaged with a fastener n to restrict the connected fastener N from shifting in the reverse direction. When the switch lever 41 is released from the on state, the press roller 16 is released from pressing, causing the winder to return the impact driver 15 to the upper limit position.

As shown in FIG. 6, when the impact driver 15 returns upward from the lower limit, the shoulders 15*a* are released to be out of contact with the right and left lower limit dampers 60. Thus, the air compressed and fed to the feed cylinder 32 returns, and the right and left lower limit dampers 60 return to their initial state, or extend upward.

The impact driver 15 moving upward feeds no compressed air to the feed cylinder 32. Then, the feed tab 33 shifts in the feed direction under an urging force from the compression spring 32*b*, and the connected fastener N is fed by one pitch to feed another fastener n to the driving path 20*b*.

The lower limit dampers 60 according to the second embodiment are also usable in the flywheel-driven driving tool 1 incorporating the feed mechanism 31 that operates with the driving operation and the magazine 30 loaded with the connected fastener N rolled in a coil.

Third Embodiment

Figure 8:
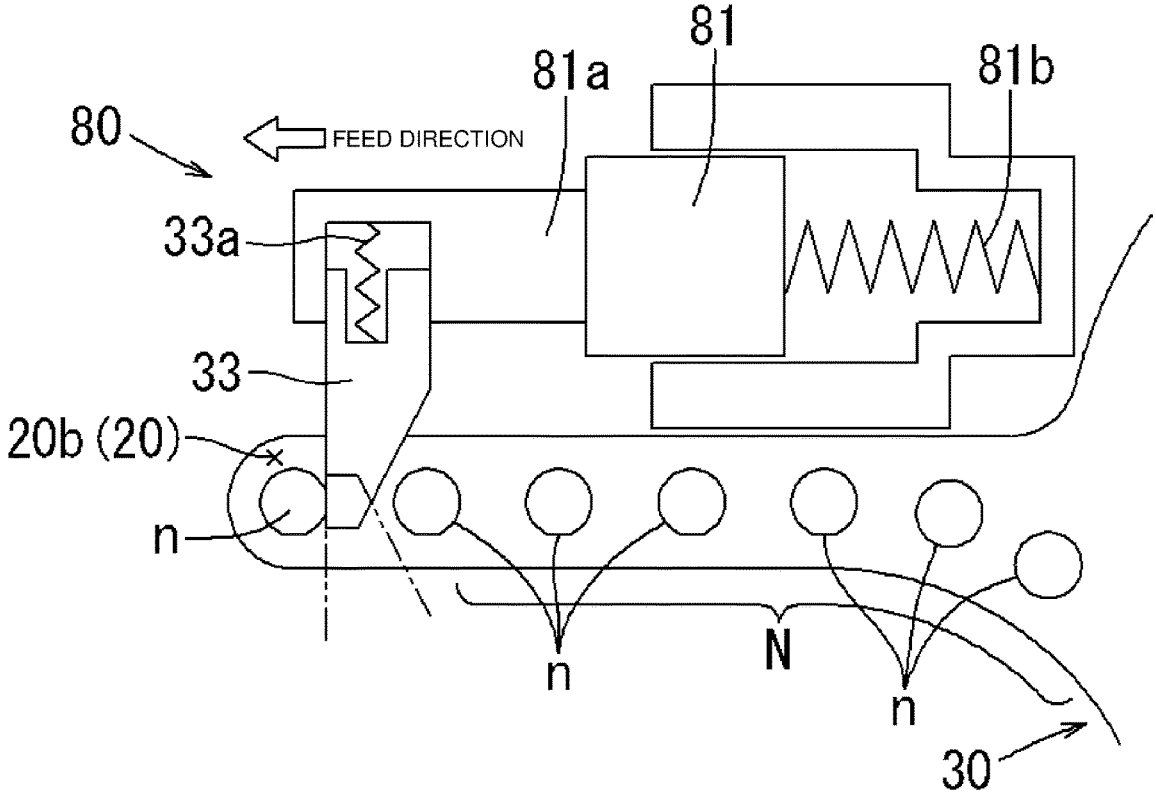
FIG. 8 is a plan view of a feed mechanism with a feed tab according to a third embodiment being shifted in the feed direction.
Figure 9:
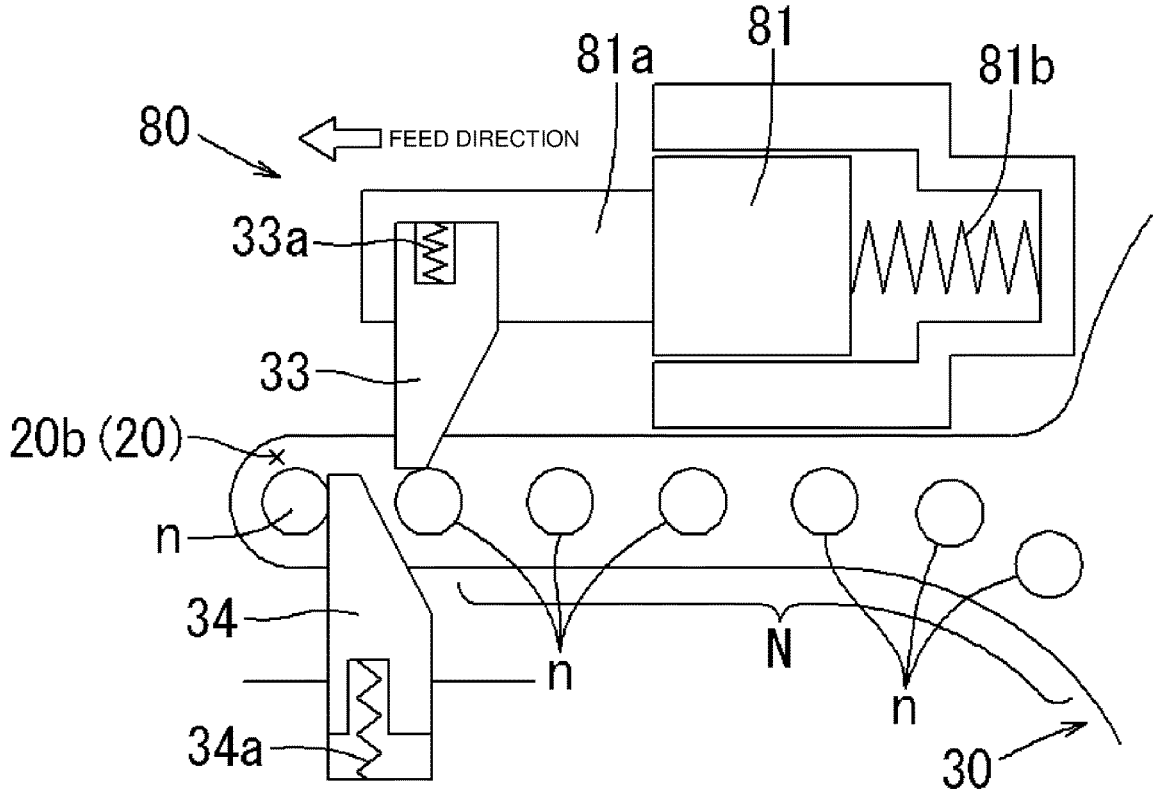
FIG. 9 is a plan view of the feed mechanism with the feed tab according to the third embodiment during returning in the reverse direction.
Figure 10:
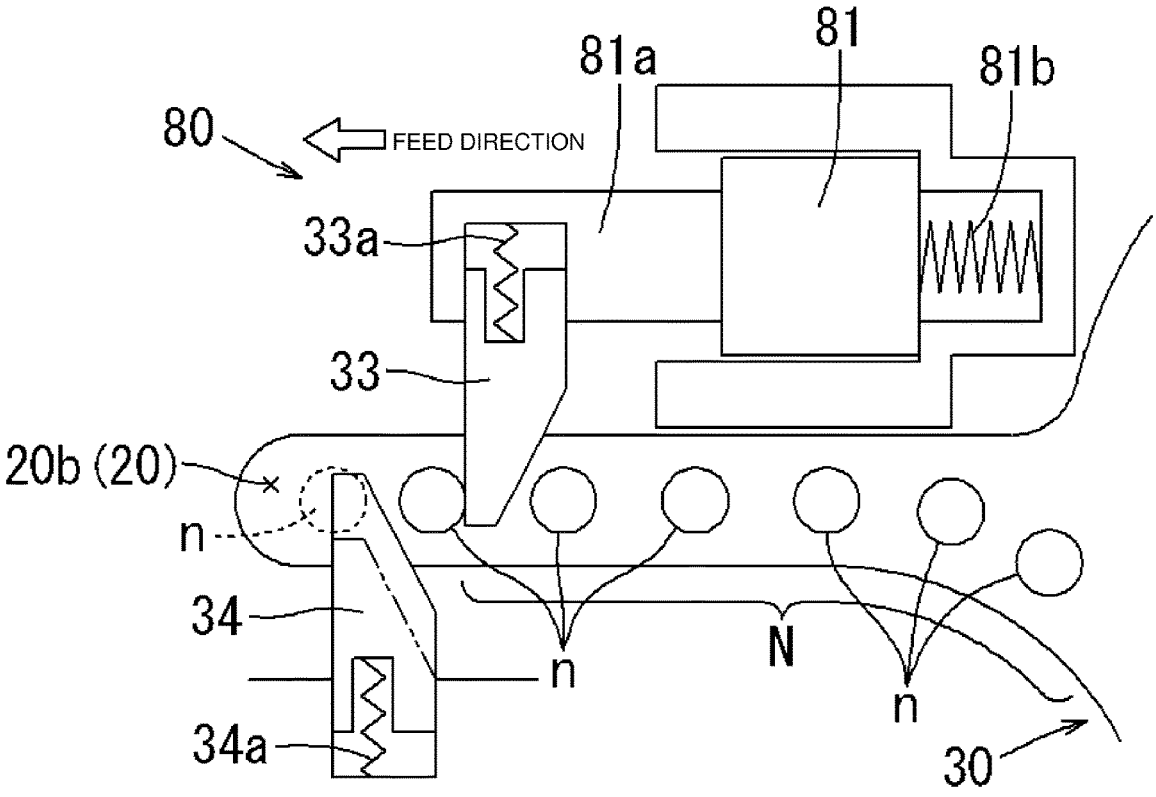
FIG. 10 is a plan view of the feed mechanism with the feed tab according to the third embodiment returning in the reverse direction.

The feed mechanism 31 may be modified further. FIGS. 8 to 10 show a feed mechanism 80 according to a third embodiment. The same components and structures as in the first and second embodiments are given the same reference numerals as those components and will not be described. The feed mechanism 80 according to the third embodiment is driven by an electromagnetic actuator and includes an electromagnetic actuator 81 as a power source, instead of the feed cylinder 32 that operates with compressed air.

The electromagnetic actuator 81 is powered by the battery 42 (common power source) to cause travel of a feed rod 81*a* to retract (in the reverse direction). When the power is cut, an urging force from a compression spring 81*b* causes travel of the feed rod 81*a* to advance (in the feed direction). The feed rod 81*a* includes a feed tab 33 at its distal end. As in the first and second embodiments, the feed tab 33 is urged by the compression spring 33*a* to protrude laterally from the feed rod 81*a*. The two stopper tabs 34 are located opposite to the feed tab 33. The two stopper tabs 34 are urged by the compression springs 34*a* to protrude toward the fasteners n.

The feed mechanism 80 driven by an electromagnetic actuator can operate without using the driving operation of the tool body 10.

As shown in FIG. 8, when power fed to the electromagnetic actuator 81 is cut, the feed rod 81*a* advances in the feed direction under an urging force from the compression spring 81*b*. The feed tab 33 then feeds the connected fastener N by one pitch to feed another fastener n to the driving path 20*b*.

As shown in FIG. 9, when the electromagnetic actuator 81 is powered, the feed rod 81*a* returns in the reverse direction. While returning, the feed tab 33 moves away from one fastener n against the compression spring 33*a* and slides over the fastener n to be at the rear of the fastener n in the feed direction. When the feed tab 33 returns in the reverse direction against the compression spring 81*b*, the two engaged stopper tabs 34 prevent the connected fastener N from shifting in the reverse direction.

As shown in FIG. 10, when power fed to the electromagnetic actuator 81 is cut again, the feed tab 33 shifts in the feed direction under an urging force from the compression spring 81*b*, and the connected fastener N is fed toward the driving path 20*b*. Subsequently, the fastener n to be fed to the driving path 20*b* moves toward the driving path 20*b* while pressing down the two stopper tabs 34 away from the fastener n against the compression springs 34*a*.

As described above, the single-acting electromagnetic actuator 81, which retracts the feed rod 81*a* with power and advances the feed rod 81*a* under a spring force, may be replaced by a double-acting electromagnetic actuator that moves the feed rod in both the directions with an electromagnetic force.

Fourth Embodiment

Figure 11:
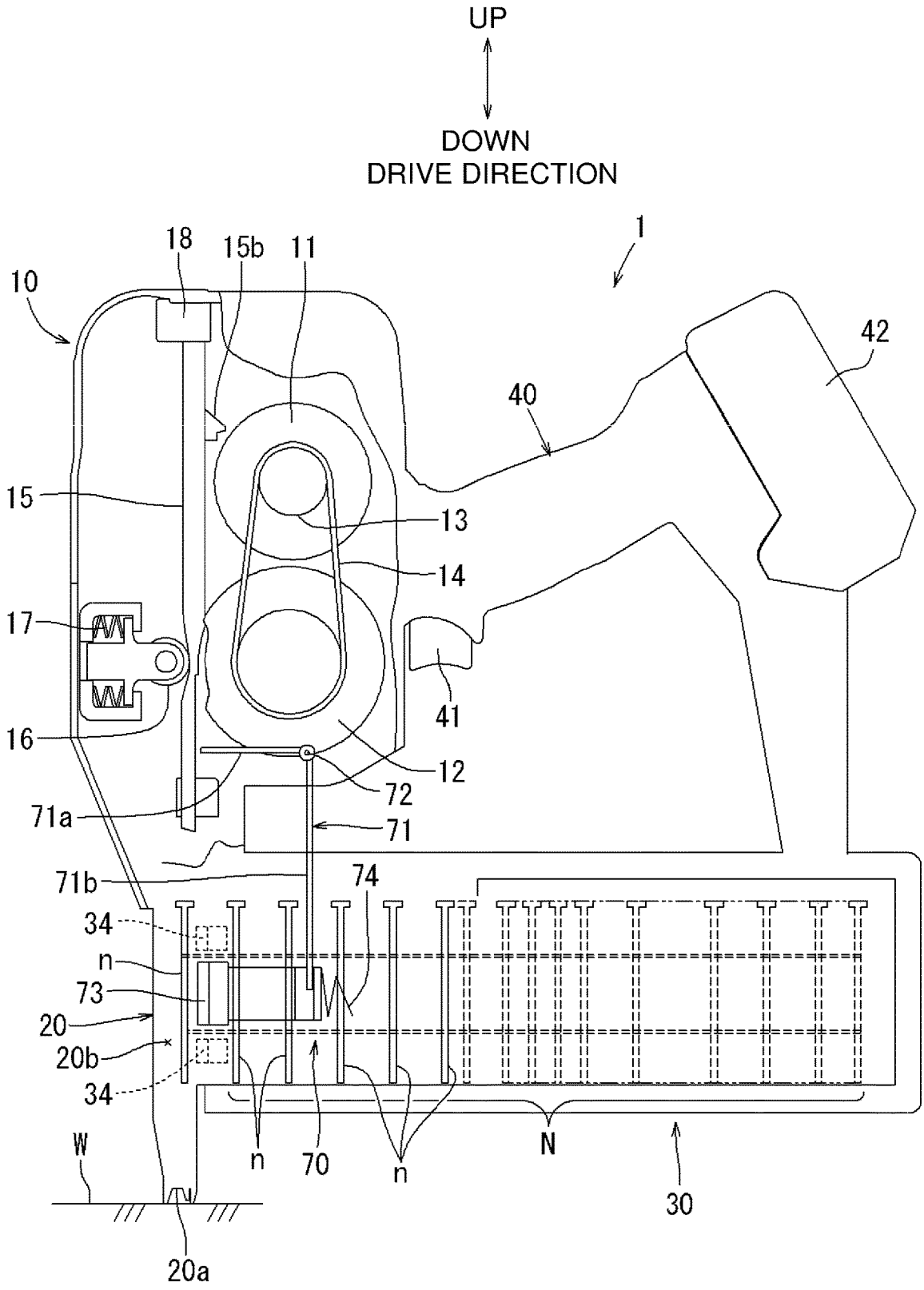
FIG. 11 is an overall side view of a flywheel-driven driving tool including the feed mechanism with an impact driver according to a fourth embodiment returning to an upper limit position and the feed tab being shifted to the feed position.
Figure 12:
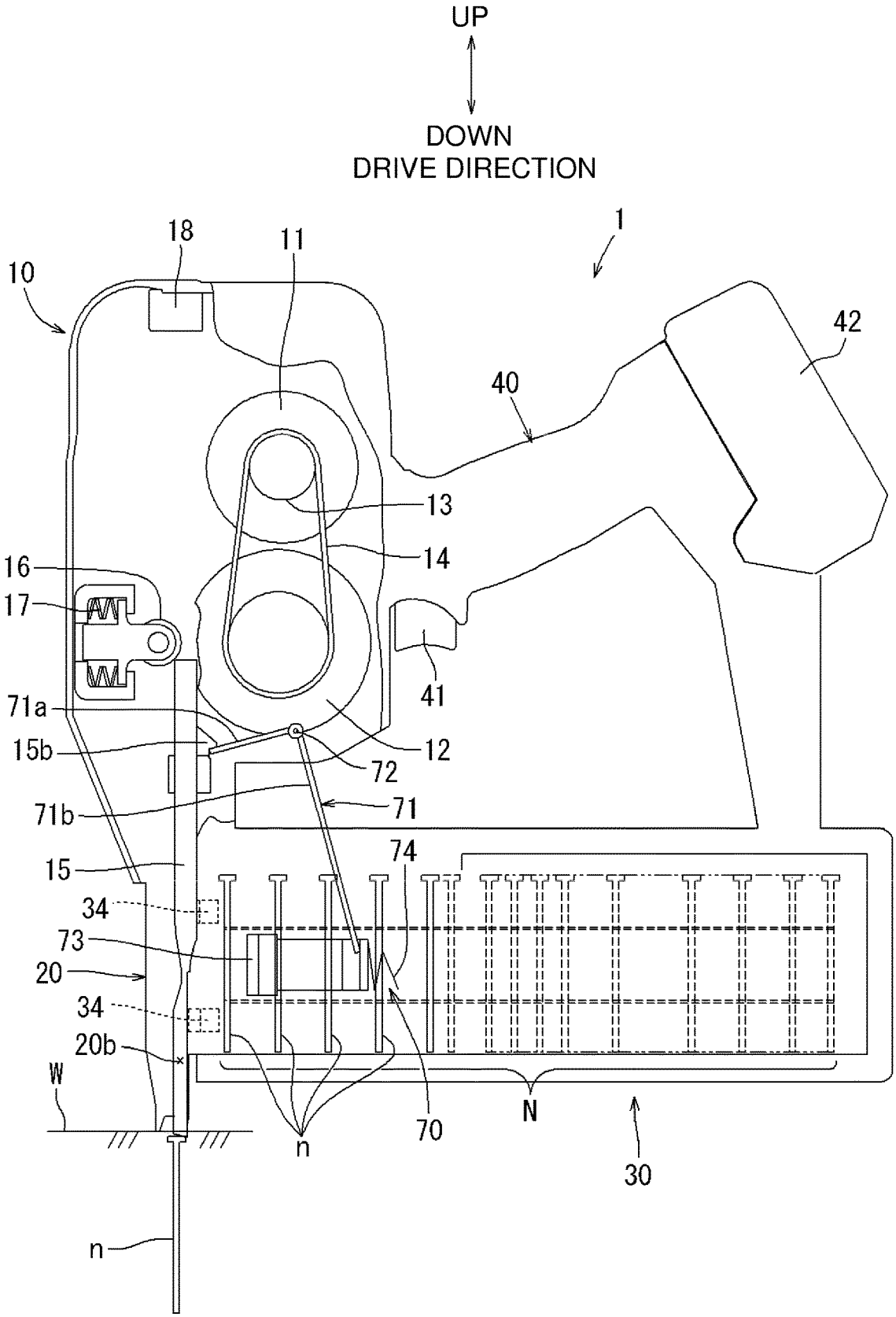
FIG. 12 is an overall side view of a flywheel-driven driving tool including a feed mechanism with the feed tab returning in the reverse direction with the impact driver according to the fourth embodiment moving downward.

FIGS. 11 and 12 show a flywheel-driven driving tool 1 including a feed mechanism 70 according to a fourth embodiment. In the fourth embodiment, the feed mechanism 70 includes a link member 71 as its main component. The link member 71 is L-shaped, and is supported by the tool body 10 with a support shaft 72 in a vertically tiltable manner. The link member 71 includes a lower arm 71*b* that extends downward from the support shaft 72 and is engaged with a feed tab 73. The feed tab 73 is urged in the feed direction by a compression spring 74. The feed tab 73 is supported in a manner reciprocable along the feed path. As in the first to third embodiments, two stopper tabs 34 are located opposite to the feed tab 33 across the feed path.

As shown in FIG. 11, in the initial state in which the impact driver 15 is at the upper limit, the lower arm 71*b* is pressed in the feed direction under an urging force from the compression spring 74, and the link member 71 tilts clockwise in the figure. Thus, the feed tab 73 shifts in the feed direction to feed one fastener n to the driving path 20*b*.

A pull of the switch lever 41 activates the wheel motor 11, causing the impact driver 15 to move downward in the drive direction. As shown in FIG. 12, immediately before the impact driver 15 reaches the lower limit position, an actuating protrusion 15*b* on the impact driver 15 comes in contact with an upper arm 71*a* of the link member 71. The upper arm 71*a* is pressed down by the actuating protrusion 15*b* while the impact driver 15 is moving downward. This tilts the link member 71 about the support shaft 72 counterclockwise in the figure.

Thus, the lower arm 71*b* shifts rightward in the figure, and the feed tab 73 returns in the reverse direction against the compression spring 74. In this state, the stopper tabs 34 prevent the connected fastener N from shifting in the reverse direction. When the switch lever 41 is released from being pulled to return the impact driver 15 to the upper limit, the actuating protrusion 15*b* is released from pressing down the link member 71. Thus, the link member 71 returns to the initial position shown in FIG. 11 under an indirect action from the compression spring 74. When the link member 71 returns to the initial position, the feed tab 73 shifts in the feed direction under an urging force from the compression spring 74 to feed another fastener n to the driving path 20*b*.

The feed mechanism 70 according to the fourth embodiment is also usable in the flywheel-driven driving tool 1 including the magazine 30 loaded with the connected fastener N rolled in a coil. The link member 71 may be operated with a specific power source such as an electric motor, or using the operation of the impact driver 15. The feed tab 73 may return in the reverse direction with the operation of the impact driver 15 and shift in the feed direction under an urging force from the compression spring 74. In contrast, the feed tab 73 may shift in the feed direction with the operation of the impact driver 15 and return in the reverse direction under an urging force from the compression spring 74.

Fifth Embodiment

Figure 13:
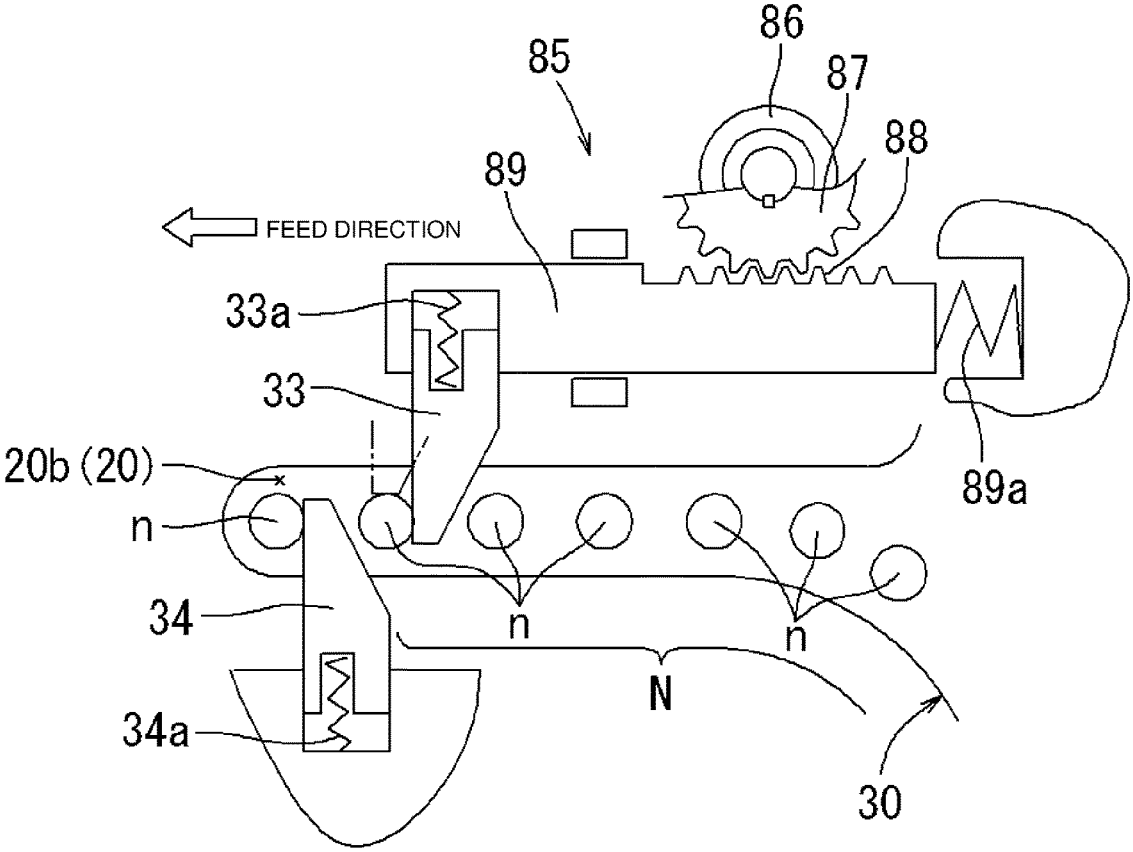
FIG. 13 is a plan view of a feed mechanism with a feed tab returning in the reverse direction in a rack-and-pinion feed mechanism according to a fifth embodiment.

A feed mechanism for feeding the connected fastener N rolled in a coil and loaded in the magazine 30 by a pitch toward the driving path 20*b* may have another structure. FIG. 13 shows a feed mechanism 85 according to a fifth embodiment. The feed mechanism 85 according to the fifth embodiment includes a pinion gear 87 and a rack gear 88. The pinion gear 87 is rotated by a feed motor 86. The rack gear 88 meshes with the pinion gear 87. The rack gear 88 is integral with a feed rod 89. The feed motor 86 is powered by the battery 42.

The feed rod 89 is urged in the feed direction by a compression spring 89*a*. As in the first embodiment, the feed rod 89 includes a feed tab 33 at its distal end. As in the first embodiment, the feed tab 33 is urged by the compression spring 33*a* to protrude toward the fasteners n. The two stopper tabs 34 are located opposite to the feed tab 33 across the feed path. The two stopper tabs 34 are urged by the compression springs 34*a* to protrude toward the fasteners n.

The stopper tabs 34 prevent the connected fastener N from shifting in the reverse direction.

When the impact driver 15 reaches the lower limit and completes driving of one fastener n, the feed motor 86 is activated to return the feed rod. Then, the pinion gear 87 and the rack gear 88 are meshed, and the feed rod 89 returns in the reverse direction against the compression spring 89*a*. Thus, the feed tab 33 retracts in the reverse direction. The feed tab 33 moves in a direction opposite to one fastener n (moves upward in FIG. 13) against the compression spring 33*a* and slides over the fastener n while retracting.

As in the first embodiment, when the feed tab 33 retracts in the reverse direction, the two stopper tabs 34 are engaged with the rear of a fastener n preceding in the feed direction. The connected fastener N is restricted from returning in the reverse direction. In this state, the feed tab 33 returns by one pitch (a pitch corresponding to a single fastener n) in the reverse direction.

The feed tab 33 is engaged with a second fastener n in a feed standby state. After the impact driver 15 reaches the lower limit and completes driving of one fastener n, the pulled switch lever 41 is released. This returns the press roller 16 to a release position, causing the winder to return the impact driver 15 to an upper limit. In this state, power from the feed motor 86 is released, and thus the feed rod 89 shifts in the feed direction under an urging force from the compression spring 89*a*, and the feed tab 33 shifts in the feed direction. When the feed tab 33 shifts in the feed direction, the connected fastener N is fed in the feed direction by one pitch. Then, one fastener n is fed to the empty driving path 20*b* after the impact driver 15 returns to the upper limit. The fed fastener n is driven through the nozzle 20*a* in the subsequent driving operation.

The rack-and-pinion feed mechanism 85 according to the fifth embodiment also feeds the connected fastener N rolled in a coil and loaded in the magazine 30 by a pitch toward the driving path 20*b* in cooperation with the driving operation of the tool body 10. Thus, the flywheel-driven driving tool 1 can also incorporate the coil magazine 30 loaded with fasteners n rolled in a coil, as in a compressed-air-driven driving tool.

The structure according to the fifth embodiment includes the feed motor 86 as a power source of the feed mechanism 85 without using compressed air as a driving source unlike in the first and second embodiments. As in the third embodiment, a lower limit damper formed from, for example, polyurethane rubber may be used to limit downward movement of the impact driver 15 and absorb impact.

Sixth Embodiment

Figure 14:
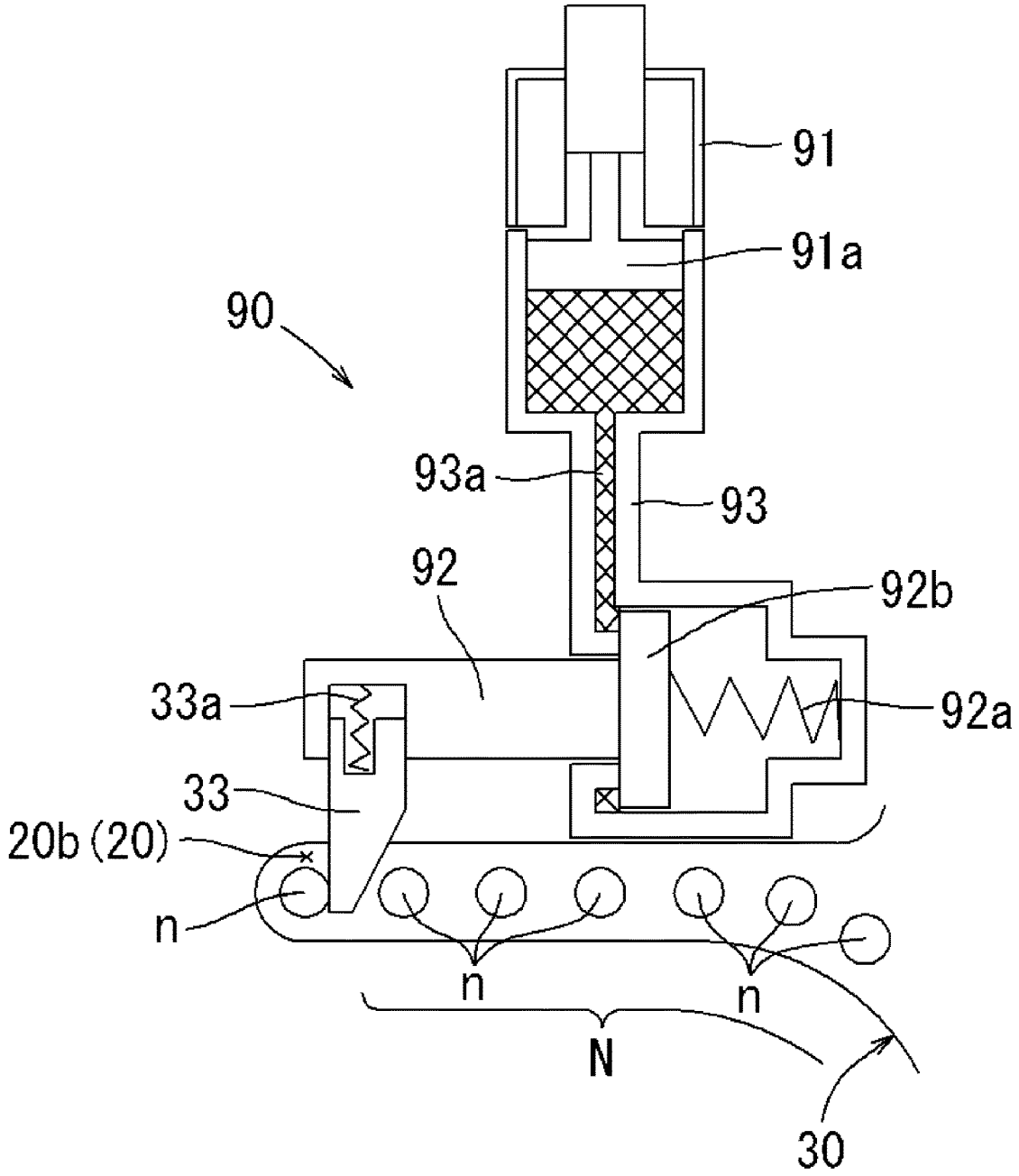
FIG. 14 is a plan view of a feed mechanism driven by an electromagnetic actuator using fluid pressure according to a sixth embodiment with a feed tab being shifted in the feed direction.
Figure 15:
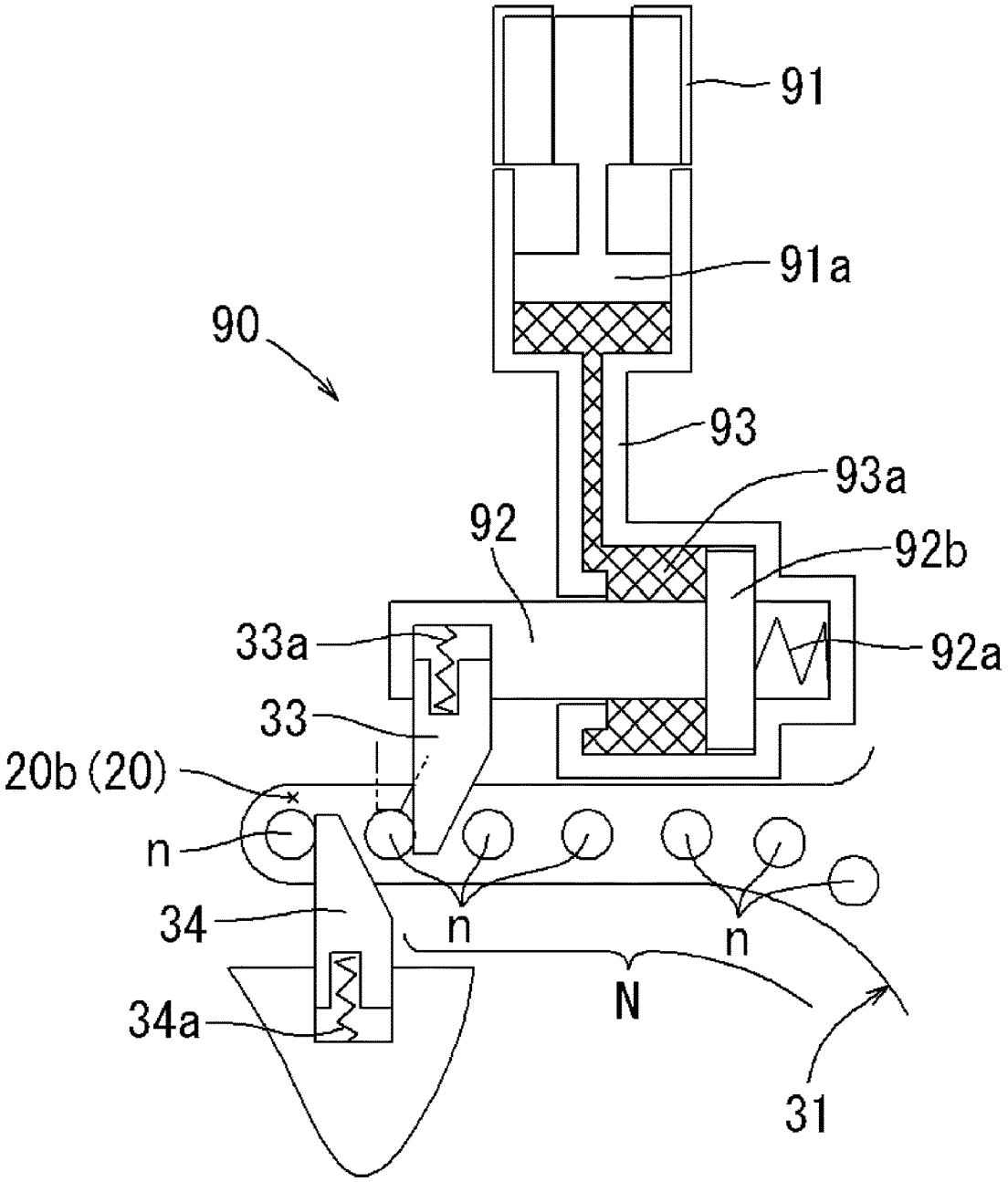
FIG. 15 is a plan view of the feed mechanism driven by the electromagnetic actuator using fluid pressure according to the sixth embodiment with the feed tab returning in the reverse direction.

FIGS. 14 and 15 show a feed mechanism 90 according to a sixth embodiment using fluid pressure. The feed mechanism 90 according to the sixth embodiment is powered by an electromagnetic actuator 91 as in the third embodiment, but differs from the third embodiment in that a fluid pressure portion 93 is placed between the electromagnetic actuator 91 and a feed rod 92 to return the feed rod 92 in the reverse direction under pressure from the fluid pressure portion 93.

The fluid pressure portion 93 is filled with oil 93*a*. A piston 91*a* of the electromagnetic actuator 91 is accommodated upstream from the fluid pressure portion 93 in a reciprocable manner. A return piston 92*b* is accommodated downstream from the fluid pressure portion 93. The oil 93*a* fills a space between the upstream piston 91*a* and the downstream piston 92*b*. The downstream piston 92*b* is integral with the feed rod 92. The feed rod 92 is urged in the feed direction by a compression spring 92*a*.

As in the first embodiment, the feed rod 92 includes the feed tab 33 at its distal end. As in the first embodiment, the feed tab 33 is urged by the compression spring 33*a* to protrude toward the fastener n. The two stopper tabs 34 are located opposite to the feed tab 33 across the feed path. The two stopper tabs 34 are urged by corresponding compression springs 34*a* to protrude toward the fasteners n. The stopper tabs 34 prevent the connected fastener N from shifting in the reverse direction.

When the impact driver 15 reaches the lower limit and completes driving of one fastener n, the electromagnetic actuator 91 protrudes. When the electromagnetic actuator 91 protrudes, the piston 91*a* shifts to enter the fluid pressure portion 93. Thus, the oil 93*a* in the fluid pressure portion 93 flows downstream. When the oil 93*a* flows downstream as shown in FIG. 15, the piston 92*b* shifts in the reverse direction against the compression spring 92*a*. Thus, the integrated feed rod 92 returns in the reverse direction, and the feed tab 33 retracts in the reverse direction. The feed tab 33 moves in a direction opposite to one fastener n (moves upward in FIG. 15) against the compression spring 33*a* and slides over the fastener n while retracting.

As in the first embodiment, while the feed tab 33 retracts in the reverse direction, the two stopper tabs 34 are engaged with the rear of a fastener n preceding in the feed direction. The connected fastener N is restricted from returning in the reverse direction. In this state, the feed tab 33 returns by one pitch (a pitch corresponding to a single fastener n) in the reverse direction.

The feed tab 33 is engaged with a second fastener n in a feed standby state. FIG. 15 shows the feed tab 33 in the feed standby state. After the impact driver 15 reaches the lower limit and completes driving of one fastener n, the pulled switch lever 41 is released. This returns the press roller 16 to a release position, causing the winder to return the impact driver 15 to an upper limit. When the impact driver 15 returns to the upper limit, the electromagnetic actuator 91 retracts as shown in FIG. 14.

When the electromagnetic actuator 91 retracts and the piston 91*a* shifts to retract from the fluid pressure portion 93, the oil 93*a* returns upstream. Thus, the fluid pressure of the oil 93*a* acting on the piston 92*b* decreases. Then, the feed rod 92 shifts in the feed direction under an urging force from the compression spring 92*a*, and the feed tab 33 thus shifts in the feed direction. When the feed tab 33 shifts in the feed direction, the connected fastener N is fed in the feed direction by one pitch. Then, another fastener n is fed to the driving path 20*b*. The fed fastener n is driven through the nozzle 20*a* in the subsequent driving operation.

The rack-and-pinion feed mechanism 90 according to the sixth embodiment also feeds the connected fastener N rolled in a coil and loaded in the magazine 30 by a pitch toward the driving path 20*b* in cooperation with the driving operation of the tool body 10. Thus, similarly to a compressed-air-driven driving tool, the flywheel-driven driving tool 1 can incorporate the coil magazine 30 loaded with the fasteners n rolled in a coil.

The feed mechanism 90 according to the sixth embodiment includes the electromagnetic actuator 91 as a power source as in the third embodiment, but differs from the third embodiment in that the feed rod 92 returns in the reverse direction under fluid pressure from the fluid pressure portion 93. Fluid pressure uniformly applied in every direction enhances the design freedom of the positional relationship between (orientation of) the electromagnetic actuator 91 and the feed tab 33. Thus, the actuation direction of the electromagnetic actuator 91 may differ from the movement direction (feed direction) of the feed rod 92, unlike in the third embodiment, and enhances the freedom in arranging the electromagnetic actuator 91. The fluid pressure portion 93 placed in between thus allows the electromagnetic actuator 91 to be arranged vertically (to be operable in the vertical direction) intersecting with the movement direction of the feed rod 92 (lateral direction in FIGS. 14 and 15) as shown in FIGS. 14 and 15. Thus, the feed mechanism 90 has a smaller size.

The structure according to the sixth embodiment is also powered by the electromagnetic actuator 91 without using compressed air as a driving source, unlike in the first and second embodiments. As in the third embodiment, a lower limit damper formed from, for example, polyurethane rubber may be used as a member for limiting downward movement of the impact driver 15 and absorbing impact. Instead of the oil 93*a* exemplified in the above embodiment, the fluid in the fluid pressure portion 93 may be other liquid such as water or other gas such as compressed air.

REFERENCE SIGNS LIST n fastener
N connected fastener
W workpiece
1 driving tool
10 tool body
11 wheel motor
12 flywheel
13 output wheel
14 driving belt
15 impact driver
15*a* shoulder
15*b* actuating protrusion
16 press roller
17 press spring
18 upper limit damper
19 wire
20 driving nose
20*a* nozzle
20*b* driving path
30 magazine
31 feed mechanism (first embodiment)
32 feed cylinder
32*a* feed rod
32*b* compression spring
33 feed tab
33*a* compression spring
34 stopper tab
34*a* compression spring
40 handle
41 switch lever
42 battery
50 lower limit damper (first embodiment)
51 base
51*a* groove
52 contact portion
52*a* vent
53 compression spring
54 air channel
60 lower limit damper (second embodiment)
60*a* air channel
70 feed mechanism (fourth embodiment)
71 link member
71*a* upper arm
71*b* lower arm
72 support shaft
73 feed tab
74 compression spring
80 feed mechanism (third embodiment)
81 electromagnetic actuator
81*a* feed rod
81*b* compression spring
85 feed mechanism (fifth embodiment)
86 feed motor
87 pinion gear
88 rack gear
89 feed rod
89*a* compression spring
90 feed mechanism (sixth embodiment)
91 electromagnetic actuator
91*a* piston
92 feed rod
92*a* compression spring
92*b* piston
93 fluid pressure portion
93*a* oil

What is claimed is:

1. A driving tool, comprising:
an electric motor;
a battery mount configured to receive a battery for powering the electric motor;
a flywheel configured to be rotated by the electric motor;
a magazine configured to contain a connected fastener rolled in a coil, the connected fastener including a plurality of fasteners connected in parallel;
an impact driver configured to advance through a driving path by rotational power of the flywheel to drive the fasteners of the plurality of fasteners;
a feed mechanism configured to feed the plurality of fasteners from the magazine to the driving path; and
an electromagnetic actuator that is configured to be a power source for the feed mechanism, wherein
the feed mechanism includes a feed tab that is configured to engage the plurality of fasteners individually and is reciprocally movable in a feed direction of the connected fastener and a reverse direction opposite the feed direction,
the feed mechanism includes a feed rod, and
the electromagnetic actuator and the feed rod are configured such that:
the electromagnetic actuator is turned off to advance the feed rod in the feed direction, and
the electromagnetic actuator is turned on to retract the feed rod in the reverse direction.

2. The driving tool according to claim 1, wherein
the feed mechanism transmits power of the electromagnetic actuator to the feed tab using fluid pressure.

3. The driving tool according to claim 1, wherein
the electromagnetic actuator is configured to be powered by the battery.

4. The driving tool according to claim 2, wherein
the electromagnetic actuator is configured to be powered by the battery.

5. The driving tool according to claim 4, wherein the feed mechanism is configured to transmit power of the electromagnetic actuator to the feed tab using oil pressure.

6. The driving tool according to claim 2, wherein A driving tool, comprising:
an electric motor;
a battery mount configured to receive a battery for powering the electric motor;

a flywheel configured to be rotated by the electric motor;

a magazine configured to contain a connected fastener rolled in a coil, the connected fastener including a plurality of fasteners connected in parallel;

an impact driver configured to advance through a driving path by rotational power of the flywheel to drive the fasteners of the plurality of fasteners;

a feed mechanism configured to feed the plurality of fasteners from the magazine to the driving path; and an electromagnetic actuator that is configured to be a power source for the feed mechanism, wherein the feed mechanism includes a feed tab that is configured to engage the plurality of fasteners individually and is reciprocally movable in a feed direction of the connected fastener and a reverse direction opposite the feed direction, and the feed mechanism is configured to transmit power of the electromagnetic actuator to the feed tab using oil pressure.

* * * * *